US005987717A

United States Patent [19]

Peterson et al.

[11] Patent Number: 5,987,717

[45] Date of Patent: Nov. 23, 1999

[54] REMOTE RELEASE LATCHING METHOD AND DEVICE

[75] Inventors: Steven R. Peterson, Brooklyn Park; Arlon J. Amundson, Wyoming, both of Minn.

[73] Assignee: Superior Flamefighter Corporation, Minneapolis, Minn.

[21] Appl. No.: 08/874,237

[22] Filed: Jun. 13, 1997

[51] Int. Cl.[6] ..... A44B 11/25

[52] U.S. Cl. ..... 24/637; 292/233

[58] Field of Search ..... 292/DIG. 25, 232, 292/233, 196, 197, 200; 248/154; 24/633, 636–642

[56] References Cited

U.S. PATENT DOCUMENTS

| | | | |
|---|---|---|---|
| 4,642,857 | 2/1987 | Ono | 24/637 |
| 5,050,277 | 9/1991 | Jimenez et al. | 24/633 |
| 5,185,910 | 2/1993 | Ziaylek, Jr. et al. | 24/650 |
| 5,353,482 | 10/1994 | Ziaylek, Jr. et al. | 24/603 |
| 5,354,029 | 10/1994 | Zlaylek, Jr. et al. | 248/313 |

*Primary Examiner*—James R. Brittain
*Attorney, Agent, or Firm*—Fredikson & Byron, P.A.

[57] ABSTRACT

A latching device capable of being remotely released and a method of remotely releasing a locking tab from a locking body. The latching device includes a locking tab comprising a shaft with an engaging recess and a head with a buckle; a locking body comprising a slide with a channel for the shaft of the locking body, a ramp and shoulder for securing the locking tab, a leg with a trigger surface, an ejector pin and ejection spring for ejecting the locking tab from the locking body and a slide biasing spring; a trigger comprising a knob, shank and foot; and an extension for attaching the latching device to a brace holding fire fighting equipment.

12 Claims, 4 Drawing Sheets

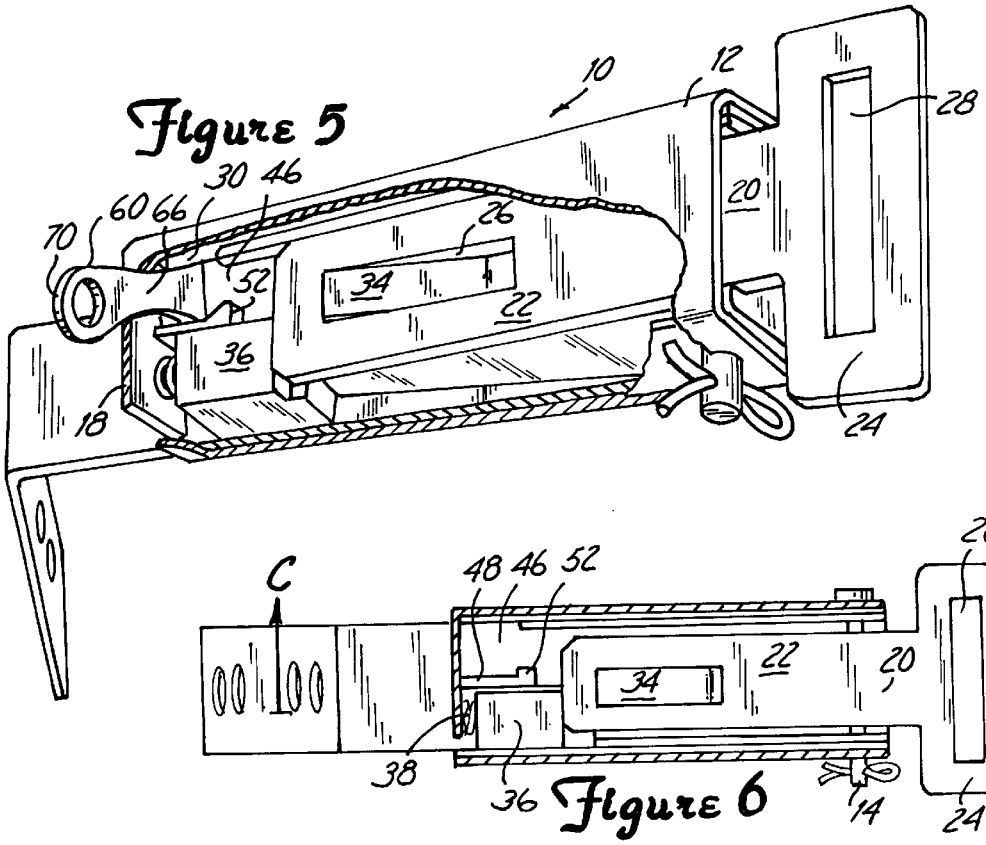
Figure 5
Figure 6
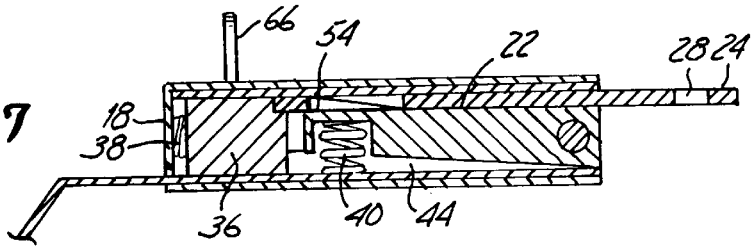
Figure 7
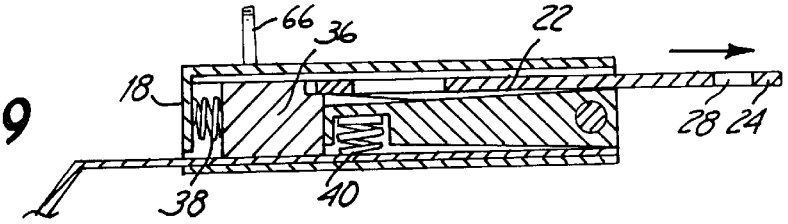
Figure 9
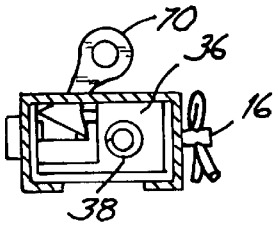
Figure 8

REMOTE RELEASE LATCHING METHOD AND DEVICE

FIELD OF THE INVENTION

The present invention relates to latching apparatus and particularly to a method and apparatus that allows for the rapid and remote release of the latching mechanism. The method and apparatus are particular suitable in safety applications such as use with fire fighting equipment.

BACKGROUND OF THE INVENTION

An important piece of equipment of a fire fighter is the Self Contained Breathing Apparatus (SCBA) which provides a fire fighter with a supply of oxygen to breath while engaging a fire. The SCBA allows a fire fighter to fight a fire under conditions where the oxygen levels in the burning structure are dangerously low due to the consumption of oxygen by the fire or where the smoke and noxious chemical resulting from the fire makes breathing difficult or dangerous.

Some fire stations store the SCBA tanks in the equipment bays within the fire engine. After the fire engine arrives at the scene of the fire, the fire fighter straps on the SCBA tank before attending to the fire. The time it takes fire fighters to begin fighting a fire can be critical to controlling the fire. Thus, the extra time required of fire fighters to secure the SCBA tanks once they arrive on the scene can have a detrimental effect on bringing the fire under control. Additionally, when fire fighters do not immediate attack the fire upon arrival, some observers at the scene perceive that the fire fighters are not adequately performing their duties and will sometimes attempt to question the fire fighters, thereby interfering with the fire fighting efforts.

In an attempt to overcome these disadvantages, some fire stations place the SCBA tanks behind the seats on the fire engine. This configuration allows the fire fighters to strap the tanks on while in route to the scene of the fire and thus, begin to fight the fire immediately upon arrival at the scene. In order to produce the time saving advantage, however, the tanks must be attached to the fire engine in a fashion that allows the fire fighter to not only easily secure the tank but also easily disengage the tank from the seat.

Many fire stations achieve these results by simply placing the tanks at the back of each seat without securing them or using very minor securing means such as velcro straps. Thus, the fire fighter belted to the seat acts as the primary means of restricting the movement of the tank. Such a configuration, however, can have extremely dangerous consequences.

It is not unusual for at least one of the seats in the fire engine to be unoccupied when the engine is traveling to a fire. In light of the high speeds and driving methods that fire engines are required to engage in to quickly travel to a fire, however, there is a relatively high risk that the driver of the fire engine will need to suddenly apply the brakes or that the fire engine could be involved in a traffic accident. When such a incidence occurs, there is little or nothing preventing the tank from hurtling out of the fire engine and causing damage to the engine and the surrounding area.

Some proposed systems attempt to overcome these problems by placing the tank in a bracket positioned behind the seat and strapping the tank into the bracket though the use of a latch and a locking tab. The tank is released from the bracket by the fire fighter manipulating a trigger arm that unlocks the tab. As mentioned, in order to be effective, the fire fighter must be able to quickly and easily release the lock securing the tank. One disadvantage of these systems is the difficulty in manipulating the trigger to release the locking tab while the fire fighter is dressed in full gear.

A possible solution to this problem is to attach a cord or rope to the trigger arm so that the fire fighter can unlock the tab by grasping and pulling on the cord rather than attempting to maneuver the trigger itself. A problem associated with this procedure, however, is that to unlock the tab, the trigger typically pivots in the direction in which the tab is exiting the latch. Once the latch is secured to the bracket, the tab usually exits the latch in a horizontal direction. The cord attached to the trigger arm, however, will naturally hang down in a vertical direction. Thus, pulling on the cord will exert forces on the trigger arm in a direction perpendicular to the force needed to release the tab. Such action will inhibit the unlocking of the latch.

A need exists, therefore, for a mechanism that will allow a SCBA tank to be properly secured to the back of fire engine seat while also allowing the tank to be quickly and easily released from the seat.

SUMMARY OF THE INVENTION

The present invention relates to a latching device that allows for the quick release of the locking mechanism. The latching device is comprised of a locking tab, a locking body into which the locking tab is secured, a trigger and an attachment extension.

In one embodiment, the locking body includes a slide with a ramp, an ejector pin, an ejection spring and a slide biasing spring. The locking tab is inserted into the locking body and over the ramp. A recess within the locking tab drops around the ramp, thereby securing the locking tab in the locking body. Inserting the locking tab into the locking body also moves an ejector causing an ejection spring to compress.

When the trigger is activated, it pivots about in a direction perpendicular to the direction in which the locking tab exits the locking body. The trigger depresses the slide and ramp holding back the locking tab. The compressed ejection spring then expands, moving the ejector into the locking tab and pushing the locking tab out of the locking body.

The latching device can be attached to a brace that supports a SCBA tank or other equipment used by fire fighters. A strap is connected to the locking tab of the latching device so that when the locking tab is inserted into the locking body, the tank is secured to the brace. A lanyard can be attached to the trigger of the latching device and strung so that it is easily accessible. Once the fire fighter has strapped on the tank, the latching device can be quickly unlocked by pulling on the lanyard, thereby activating the trigger mechanism and causing the locking tab to exit the locking body. The fire fighter is then able to depart from the fire truck with the tank.

BRIEF DESCRIPTION OF THE DRAWINGS

FIG. 5 is perspective view of the invention with a cutaway showing the latch with the tab inserted.

FIG. 6 is top view of the invention with the tab inserted with the top of the latch removed.

FIG. 7 is a cross-sectional view of the invention with the tab inserted taken along line C—C.

FIG. 8 is a cross-sectional view of the invention with the tab inserted taken along line D—D.

FIG. 9 is a cross-sectional view of the invention with the tab partially inserted.

DETAILED DESCRIPTION OF THE INVENTION

Figure 1:
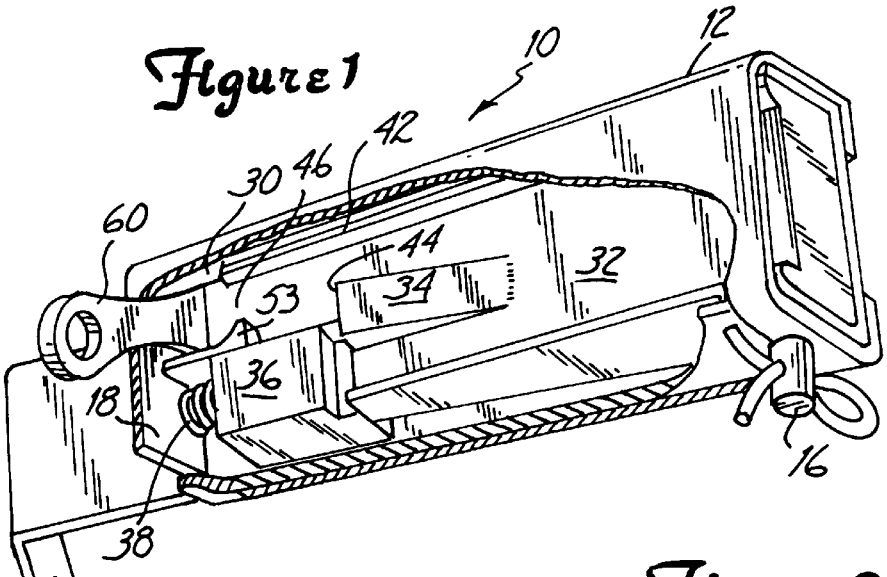
FIG. 1 is perspective view of the invention with a cutaway showing the latch without the tab.

FIGS. 1–10 depict the present invention, a remote releasible latching device 10. The latching device 10 is comprised of a locking tab 20, a locking body 30 into which the locking tab 20 is secured, a trigger 60 and an attachment extension 50. The locking body includes a slide 32 with a ramp 34, an ejector pin 36, an ejection spring 38 and a slide biasing spring 40.

Referring to FIGS. 5 and 6, the locking tab 20 has a shaft 22 and a head 24. The size and shape of the locking tab 20 can be of any suitable dimension and configuration. It is desirable for the shaft 22 to fit snugly within the locking body 30 of the latching device 10. In the preferred embodiment, the shaft 22 is generally elongated and rectangular in shape.

The configuration of the shaft 22 includes an engaging recess 26 for mating the shaft 22 with the ramp 34 on the slide 32, as explained below. The engaging recess 26 is positioned towards the rear end of the shaft 22 and is shaped so that its outside dimensions correspond with those of the ramp 34. In the preferred embodiment, the engaging recess 26 is generally of an elongated rectangular nature.

As mentioned, the engaging recess 26 mates the shaft 22 of the locking tab 20 with the ramp 34 on the slide 32. In the preferred embodiment, the walls of the engaging recess 26 are generally vertical and form angles of approximately 90° with the adjacent walls of the shaft 22. This configuration serves to reduce the potential for slippage occurring between the engaging recess 26 and the ramp 34.

Figure 11:
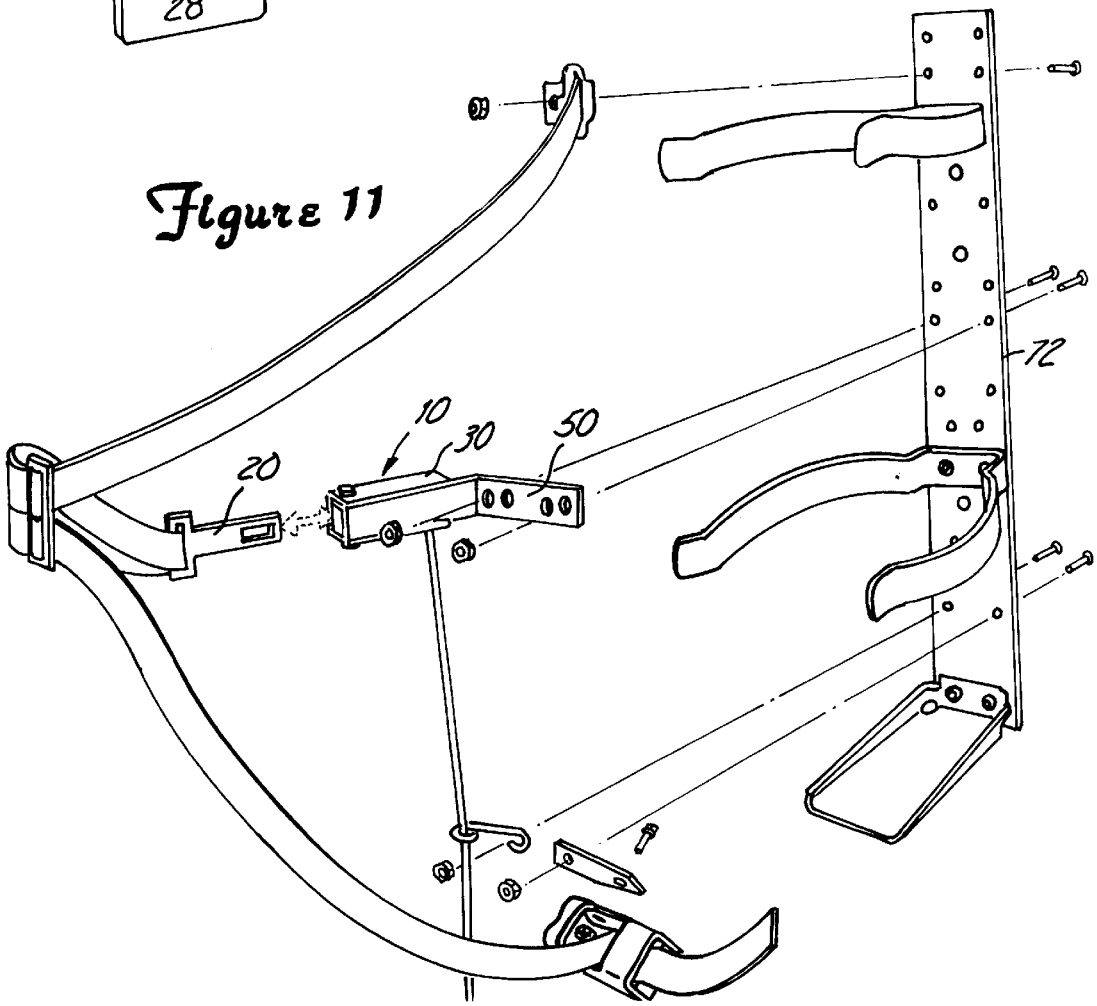
FIG. 11 is perspective view of the invention showing one manner of attachment to the bracket.

The head 24 of the locking tab 20 is affixed to the shaft 22 at the front end of the shaft 22 so that the head 24 resides outside of the locking body 30 when the locking tab 20 is inserted into the locking body 30 and the latching device 10 is locked. The head 24 encompasses a buckle 28 with a slot. As shown in FIG. 11, the buckle 28 can receive a belt, strap or other appropriate device that is used to secure the SCBA to a brace 72, thereby allowing the SCBA to be stabilized when the locking tab 20 is inserted into the locking body 30.

The buckle 28 can be of any suitable configuration. In the preferred embodiment, the slot of the buckle 28 is of an elongated racetrack design to facilitate the passage of the SCBA attachment. Also in the preferred embodiment, the corners of the shaft 22 and the head 24 are rounded to guard against the possibility of harm occurring from the use of the latching device 10, particularly when the locking tab 20 is ejected from the locking body 30.

Figure 2:
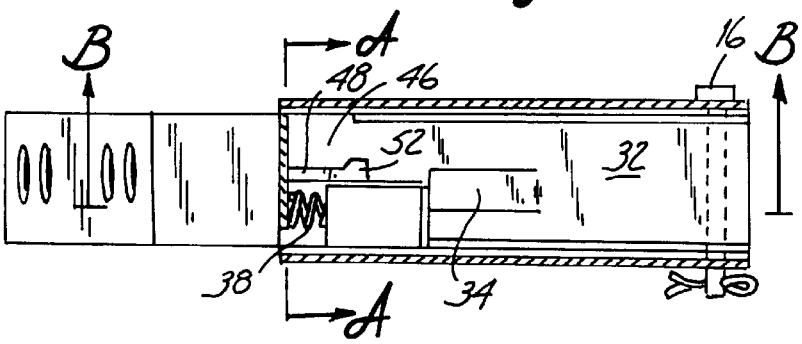
FIG. 2 is top view of the invention without the tab with the top of the latch removed.
Figure 3:
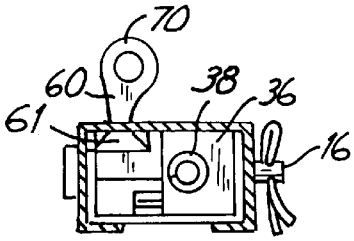
FIG. 3 is a cross-sectional view of the invention without the tab taken along line A—A.
Figure 4:
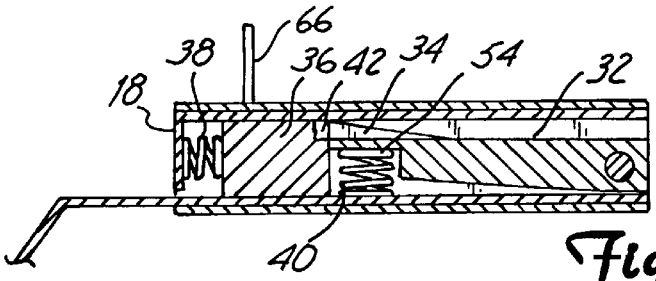
FIG. 4 is a cross-sectional view of the invention without the tab taken along line B—B.
Figure 10:
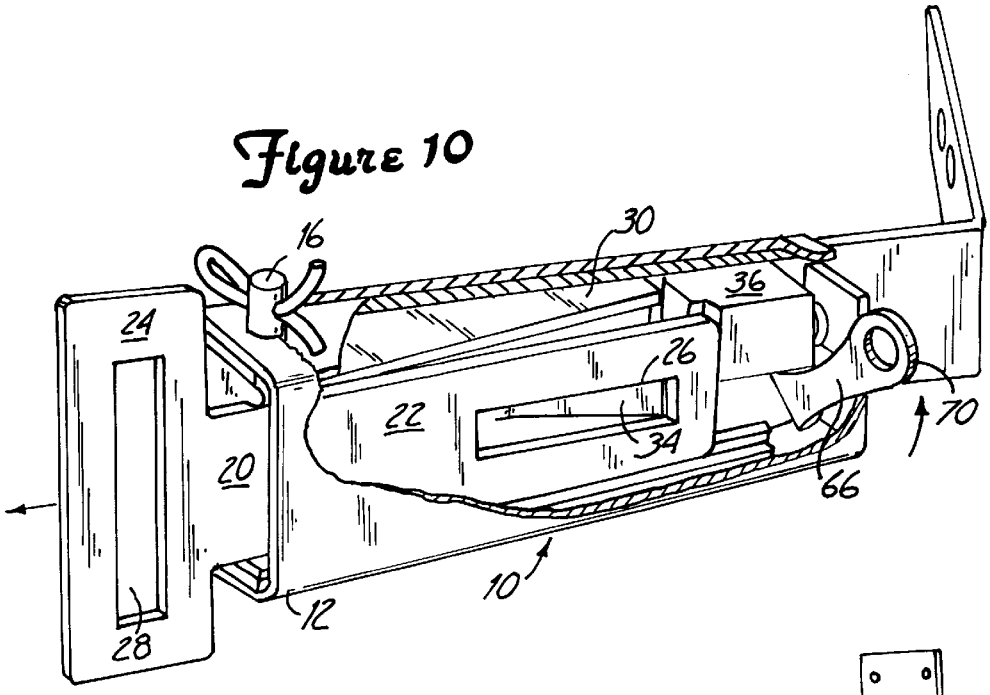
FIG. 10 is a perspective view of the invention with a cutaway showing the latch with the tab exiting the latch.

As can be seen in FIGS. 1 and 2, the locking body 30 is comprised of a housing 12 defining a hollow enclosure. The housing 12 can be formed from a single section or multiple sections secured together through appropriate means. In the preferred embodiment, the housing 12 is formed of an inner shell which is encompassed by an outer shell. Residing within the enclosure is a slide 32 in which the locking tab 20 can be secured, an ejector pin 36, an ejection spring 38 and a slide biasing spring 40. When the latching device 10 is in the locked position, the locking tab 20 is secured within the housing 12.

The slide 32 is configured to receive the shaft 22 of the locking tab 20. In the preferred embodiment, the slide 32 has two opposing ledges 42 extending upwardly from the slide 32. The ledges 42 are positioned at the outer edges of the slide 32 so as to form a channel through which the shaft 22 of the locking tab 20 can travel.

A ramp 34 is located between the ledges 42 towards the rear end of the slide 32. In the preferred embodiment, the ramp 34 is spaced equally between the ledges 42 with the distance from the front end of the slide 32 to the back end of the ramp 34 approximating the length of the shaft 22 of the locking tab 20 as measured from the front end of the shaft 22 to the back end of the engaging recess 26. In this configuration, when the locking tab 20 is secured within the locking body 30, the head 24 and a portion of the shaft 22 of the locking tab 20 protrudes from the housing 12.

The ramp 34 and corresponding engaging recess 26 can be of any appropriate configuration that allows for the locking tab 20 to be secured within the housing 12. For instance, the ramp could consist of a compressible detent that can expand into the engaging recess. In the preferred embodiment, the ramp 34 is generally rectangular in shape and inclines upwardly towards the rear end of the slide 32. The incline of the ramp 34 terminates into a shoulder 44. The shoulder 44 is comprised of a generally vertical abutment which prevents the locking tab 20 from exiting the housing 12 before the trigger 60 is engaged.

A segment of the slide 32 also extends rearwardly to form a leg 46. One of the ledges 42 of the slide 32 stretches partially down the outside edge of the leg 46. A flange 48 spans along a portion of the opposing inside edge of the leg 46 from the rear of the leg 46 up towards the ramp 34. The flange 48 concludes in an abutment 52 that partially protrudes into the surface of the leg 46. The abutment 52 acts to limit the rearward motion of the shaft 22 of the locking tab 20. The rear edge, side edge, flange 48 and abutment 52 of the leg 46 act to define a trigger surface 62 for biasing the trigger 60.

In the preferred embodiment, the slide 32 is sloped downwardly so that the rear end is shorter than the front end. The slide 32 is affixed to the housing 12 through any appropriate means. In the preferred embodiment, the slide 32 contains an opening 56 that extends through the entire width of the slide 32. Also in the preferred embodiment, the opening 56 is situated towards the front end of the slide 32 and below the longitudinal axis defined across the front end of the slide 32. Corresponding holes 14 are located in the housing 12. The slide 32 and housing 12 are then fastened together through any suitable attachment means such as screws, nails or bolts. In the preferred embodiment, a pin 16 is used to fasten the slide 32 and housing 12 together.

The underside of the slide 32 contains a depression 54 which, in the preferred embodiment, is positioned approximately underneath the ramp 34. A slide biasing spring 40 resides within the depression 54 secured between the slide 32 and the bottom of the housing 12. The incline of the slide 32 results in a gap between the housing 12 and the rear portion of the slide 32. The slide biasing spring 40 serves to urge the slide 32 upwardly and pivot the slide 32 around the pin 16.

The housing 12 also includes an ejector pin 36 that is stationed behind the slide 12 and adjacent to the leg 46. The ejector pin 36 can be of any formation but is desirably of a generally rectangular or block-like configuration. The length of the ejector pin 36 is less than the length of the adjacent leg 46 and the ejector pin 36 is free to move longitudinally within the housing 12. In the preferred embodiment, the top section of the housing 12 is curved over the rear portion of the hollow enclosure. This overhang 18 limits the rearward motion of the ejector pin 36.

The front face of the ejector pin 36 is capable of propelling the locking tab 20 out of and away from the housing 12. Although a variety of methods can be employed to accomplish this task, in the preferred embodiment, the front face of the ejector pin 36 contains a shelf 58. The shelf 58 is positioned on the ejector pin 36 so that a portion of the rear end of the shaft 22 of the locking tab 20 abuts the shelf 58 when the locking tab 20 is inserted into the locking body 30 and locked.

In the preferred embodiment, a cavity 64 is bored into the rear end of the ejector pin 36. An ejection spring 38 is located within the cavity 64 and secured between the ejector pin 36 and the overhang 18. The ejection spring 38 functions to urge the ejector pin 36 towards the front of the slide 32.

The locking tab 20 is released from the locking body 30 through the use of a trigger 60. The trigger 60 includes a knob 70 and a foot 68 connected by a shank 66. The shank 66 extends from the hollow enclosure through a hole 74 in the top surface of the housing 12. The knob 70 is located externally of the housing 12 at one end of the shank 66 and is used to engage the trigger 60. In the preferred embodiment, the knob 70 is formed into the shape of a loop so that a remote triggering means, such as a cord, can be attached to the loop and used to prompt the trigger 60. Thus, the trigger 60 can be engaged directly by manual means or remotely through the use of an extension attached to the knob 70 of the trigger 60.

Attached to the end of the shank 66 opposite the knob 70 is a foot 68. Although the foot 68 can be of any suitable shape, in the preferred embodiment, it is generally rectangular in shape with two points located at opposing ends and a bottom surface that is generally flat. Also in the preferred embodiment, the foot 68 is contoured so that its dimensions extend beyond those of the hole 74 to prevent the foot 68 from inadvertently exiting the housing 12 through the hole 74.

The foot 68 is located within the housing 12 so that it is capable of contacting the trigger surface 62 on the leg 46. In the preferred embodiment, the foot 68 remains in constant contact with the trigger surface 62. Although the trigger 60 can be positioned within the hole 74 in a variety of orientations, in the preferred embodiment, the trigger 60 is aligned along the longitudinal axis of the housing 12 so that it is capable of pivoting about this axis and perpendicular to the direction in which the locking tab 20 exits the locking body 30.

As can be seen in FIG. 11, in the preferred embodiment, the latching device 10 can be attached to a brace 72 that is also used to hold and secure a SCBA tank. The SCBA tank typically is secured in a vertical fashion. Thus, the strap that passes through the buckle 28 and restrains the SCBA tank will commonly wrap across the tank in a generally horizontal direction. Similarly, the latching device 10 will also typically be secured to the brace 72 in a generally horizontal fashion as well. If the trigger 60 is to be remotely activated, a cord will be attached to the knob 70. This cord will naturally hang vertically. The configuration of the trigger 60 allows it to pivot in the same direction as the force that is applied on the cord to activate the trigger 60.

In the preferred embodiment, the housing 12 includes two additional holes 76, 78. One of the holes 76 is located in the side surface of the housing 12 adjacent to the trigger 60 while the other hole 78 is located in the bottom surface of the housing 12 generally below the foot 68 of the trigger 60. One point of the foot 68 is capable of resting within the side surface hole 76 thereby positioning the trigger 60 in a generally upright manner. The bottom surface hole 78 is of sufficient size to allow the entire trigger 60 to pass through it. Thus, if desired, the latching device 10 can be dismantled and the trigger 60 removed from the housing 12.

The latching device 10 can be attached to the brace 72 through any suitable means. In the preferred embodiment, the latching device 10 includes an attachment extension 50 which is capable of being secured to the brace 72. The bottom surface of the housing 12 extends outwardly and downwardly to form the attachment extension 50. Perforations can be placed on the attachment extension 50 to aid in its connection to the brace 72.

In use, the latching device 10 is secured to the brace 72 through the use of the attachment extension 50. A strap is then run through the buckle 28 on the head 24 of the locking tab 20. The SCBA tank can then be inserted into the brace 72 and encompassed by the strap. As fire fighters carry the tanks on their backs in a vertical orientation, the tank will be positioned vertically in the brace 72. Under normal operations, the latching device 10 will be attached to the brace 72 horizontally so that the locking tab 20 exits the locking body 30 in a horizontal direction.

When the locking tab 20 is not secured within the locking body 30, the slide biasing spring 40 pivots the leg 46 and rear end of the slide 32 upward around the pin 16 so that the leg 46 rests against the inside of the top surface of the housing 12. Similarly, the ejection spring 38 urges the ejector pin 36 towards the front of the housing 12 so that it rest against the rear end of the slide 32 and the shoulder 44 of the ramp 34.

To lock the latching device 10, the shaft 22 of the locking tab 20 is inserted into the housing 12 along the channel of the slide 32. As the rear end of the shaft 22 travels down the slide 32 it begins to pivot the slide 32 and leg 46 downward and compress the slide biasing spring 40. When the shaft 22 encounters the ramp 34, the incline of the ramp 34 causes the shaft to glide up the ramp 34. As the shaft 22 moves towards the shoulder 44, it will encounter the ejector pin 36 and begin to push the ejector pin 36 towards the housing overhang 18 while compressing the ejection spring 38.

Once the engaging recess 26 of the shaft 22 reaches the shoulder 44, the shaft 22 descends back into the channel of the slide 32 so that the engaging recess 26 surrounds the ramp 34. The rear tip of the shaft 22 will be positioned behind the shoulder 44 and will rest on the shelf 58 of the ejector pin 36 with the ejection spring 38 compressed in the opening 56. The slide biasing spring 40 will again urge the slide 32 upward so that the shoulder 44 remains positioned within the engaging recess 26, thereby preventing the locking tab 20 from exiting the locking body 30.

When the engaging recess 26 drops around the ramp 34 and shoulder 44, a click will be heard as the slide biasing spring 40 snaps the slide 32 back towards the top surface of the housing 12. This noise notifies the operator that the locking tab 20 has been secured within the locking body 30.

In normal operation, a lanyard cord will be attached to the knob 70 of the trigger 60 to allow for remote release of the latching device 10. The cord can be passed through a series of guides that form a pathway for the lanyard to travel when pulled. The guides can be positioned on the brace, seat or other structure as appropriate.

Figure 12:
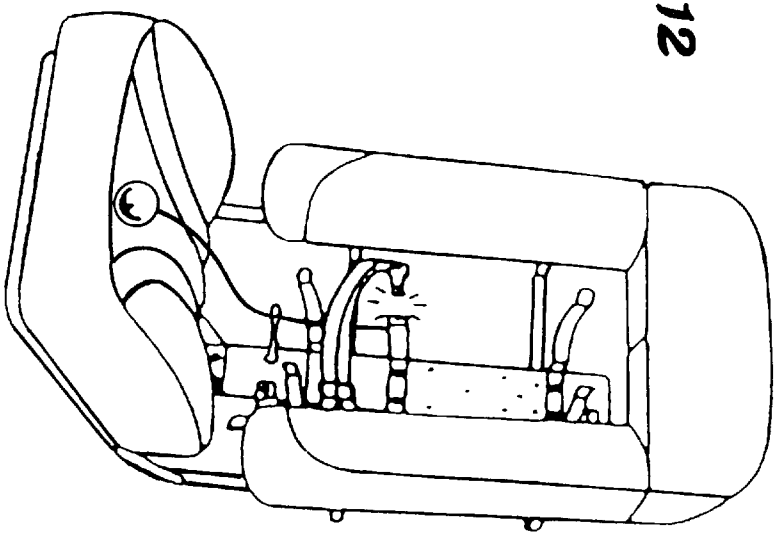
FIG. 12 is a perspective view of an embodiment of the lanyard cord of the invention.
Figure 13:
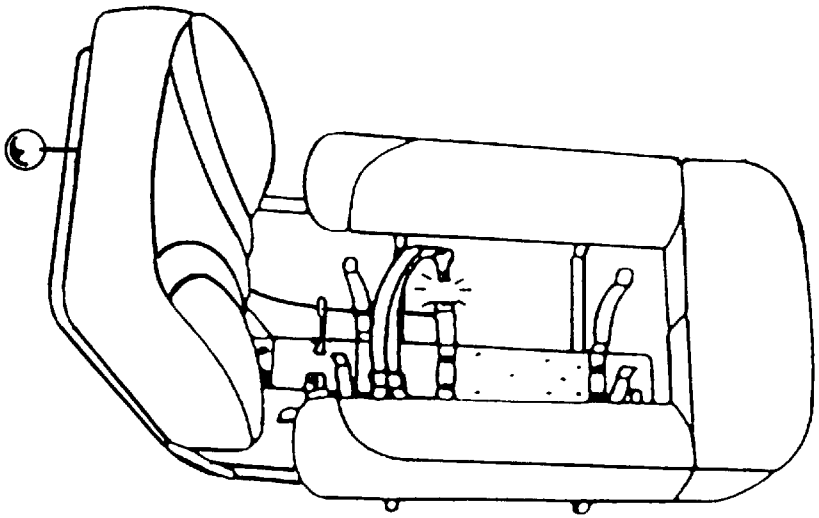
FIG. 13 is a perspective view of an alternate embodiment of the lanyard cord of the invention.
Figure 14:
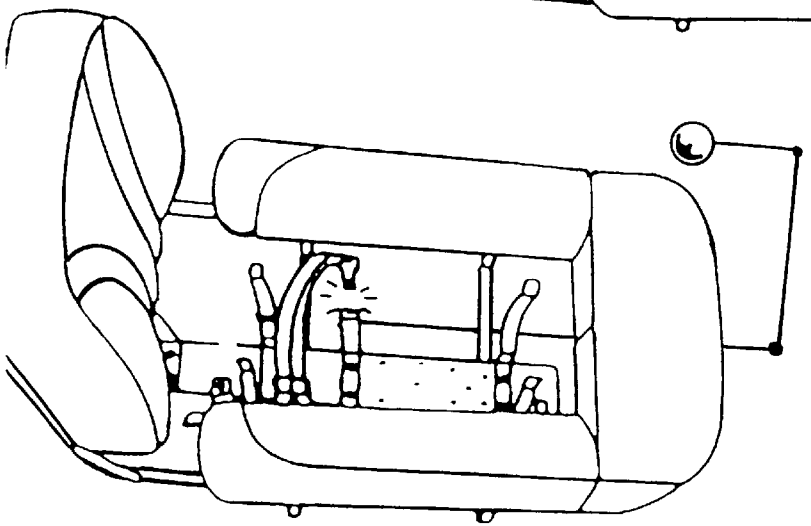
FIG. 14 is a perspective view of an alternate embodiment of the lanyard cord of the invention.

The remote releasible feature of the latching device 10 has the advantage of allowing the trigger 60 to be activated from a convenient location away from the latching device 10 itself. For instance, the lanyard could be strung through the guides so that it is easily accessible to the fire fighter. If desired, a knob can be secured to the end of the lanyard to allow the fire fighter to grab the lanyard and activate the trigger without the lanyard sliding through the gloved hand. As can be seen in FIGS. 12–14, the knob of the lanyard is located above the head of the fire fighter, between the fire fighter's legs or along the side of the fire truck seat.

To unlock the latching device 10, the fire fighter pulls on the lanyard. This acts to pivot the trigger 60 causing the foot 68 to press against the trigger surface 62 on the leg 46 of the slide 32. The action of the foot 68 depresses the trigger surface 62, thereby compressing the slide biasing spring 40. The shoulder 44 is moved downward while the shaft 22 of the locking tab 20 rests on the shelf 58 of ejector pin 36 and remains stationary. The shoulder 44 is thus withdrawn from the engaging recess 26 of the shaft 22. As the resistance compressing the ejection spring 38 is now removed, the ejection spring 38 expands, pushing the ejector pin 36 forward against the shaft 22 of the locking tab and causing the locking tab 20 to exit the locking body 30. The tank can then be removed from the brace 72.

In use under normal operating conditions, braces 72 containing the latching devices 10 would be situated behind the seats in a fire truck. A strap is attached to the braces 72 and passed through the buckle 28 of the locking tab 20. The SCBA or other desired tanks are secured to the braces 72 with the strap and the locking tab 20 is inserted into the locking body 30, thereby locking the latching device 10. In some instances, a fire truck traveling to a fire will contain some empty seats. If the fire truck must quickly apply its brakes, the locked latching device 10 will prevent the tank from being thrown from the brace 72.

If a fire fighter occupying a seat wishes to be equipped with the tank, the fire fighter can strap on the tank while on route to the fire. Once the fire truck arrives at the fire, the fire fighter can quickly unlock the latching device 10 by pulling on the lanyard. This action will activate the trigger 60 causing the locking tab 20 to exit the locking body 30. The fire fighter can then leave the truck.

While a preferred embodiment of the present invention has been described, it should be understood that various changes, adaptations and modifications may be made therein without departing from the spirit of the invention and the scope of the appended claims.

I claim:

1. A remote release latching device, comprising:

a locking tab which has an engaging recess;

a locking body which includes a housing;

a locking ramp internal to the housing so that the ramp is capable of interaction with the locking tab's engaging recess upon insertion of the locking tab;

an ejector which includes a spring contacting a pin which are placed within the housing so that the ejector abuts the locking tab after insertion into the housing;

a trigger surface contacting the locking ramp; and a trigger which passes through the housing, is adjacent to the trigger surface, is capable of movement perpendicular to the housing, and is adapted to receive a lanyard.

2. The device of claim 1 further comprising a channel internal to the housing which allows insertion of said locking tab.

3. The device of claim 1 further comprising a lanyard attached to said trigger.

4. The device of claim 3 further comprising a plurality of lanyard guides positioned so that said lanyard passes through each guide and that said guides form a pathway for the lanyard to travel when force is applied.

5. The device of claim 4 wherein said lanyard guides form a pathway which allows a vertical exertion of force upon the lanyard.

6. The device of claim 1 further comprising a tank holder to which said locking body is attached.

7. The device of claim 6 wherein said tank holder is an oxygen tank holder.

8. A remote release latching device, comprising:

a locking tab which has an engaging recess;

a locking body which includes a housing;

a channel internal to the housing which allows insertion of the locking tab;

a locking ramp internal to the housing so that the ramp is capable of interaction with the locking tab's engaging recess upon insertion of the locking tab;

an ejector which includes a spring contacting a pin which are placed within the housing so that the ejector abuts the locking tab after insertion into the housing;

a trigger surface contacting the locking ramp;

a trigger which passes through the housing, is adjacent to the trigger surface and is capable of movement perpendicular to the housing; and a lanyard attached to said trigger.

9. A remote release latching device, comprising:

an oxygen tank holder;

a locking tab which has an engaging recess;

a locking body which includes a housing and is attached to the tank holder;

a channel internal to the housing which allows insertion of the locking tab;

a locking ramp internal to the housing so that the ramp is capable of interaction with the locking tab's engaging recess upon insertion of the locking tab;

an ejector which includes a spring contacting a pin which are placed within the housing so that the ejector abuts the locking tab after insertion into the housing;

a trigger surface contacting the locking ramp;

a trigger which passes through the housing, is adjacent to the trigger surface and is capable of movement perpendicular to the housing; and a lanyard attached to said trigger.

10. A method of using a remote release latching device, comprising the steps of:

insertion of a locking tab which has a locking recess into a locking body;

where a locking ramp engages a locking tab's engaging recess; and where the locking tab contacts an ejector which also contacts a trigger; and where at a later time force is applied to the trigger in a direction that is perpendicular to the locking body by pulling a lanyard attached to the trigger;

and where the movement of the trigger results in the exertion of force upon the trigger surface by the trigger;

which results in the separation of the locking ramp from the locking tab engaging recess; and where the ejector exerts a force upon the locking tab which then ejects the locking tab from the channel.

11. The method of claim 10 wherein, the lanyard is pulled in a vertical fashion to initiate the release of said locking tab.

12. A method of using a remote release latching device, comprising the steps of:

placing an oxygen tank adjacent to a tank holder where the tank is then secured by;

insertion of a locking tab which has a locking recess into a locking body;

where a locking ramp engages a locking tab's engaging recess; and where the locking tab contacts an ejector which also contacts a trigger; and where at a later time force is applied to the trigger in a direction that is perpendicular to the locking body by pulling a lanyard attached to the trigger;

and where the movement of the trigger results in the exertion of force upon the trigger surface by the trigger;

which results in the separation of the locking ramp from the locking tab engaging recess; and where the ejector exerts a force upon the locking tab which then ejects the locking tab from the channel.

* * * * *